United States Patent [19]

Wilson et al.

[11] 4,397,638

[45] Aug. 9, 1983

[54] SOLID BOWL CENTRIFUGE WITH INTERMITTENT RIM DISCHARGE

[75] Inventors: Peter C. Wilson, Dillon, Colo.; Eudore A. Berry, Longview, Wash.

[73] Assignee: Fiberfuge Company, Denver, Colo.

[21] Appl. No.: 329,693

[22] Filed: Dec. 11, 1981

[51] Int. Cl.[3] ..... B04B 1/10; B04B 1/20

[52] U.S. Cl. ..... 494/40; 494/56

[58] Field of Search ..... 494/52, 53, 54, 56, 494/57, 40

[56] References Cited

U.S. PATENT DOCUMENTS 917,120 4/1909 Peck ..... 494/52

1,933,644 11/1933 Trump ..... 494/52 X

*Primary Examiner*—Harvey C. Hornsby

*Assistant Examiner*—Shewen Bian

*Attorney, Agent, or Firm*—W. Scott Carson

[57] ABSTRACT

A continuous feed, solid bowl centrifuge with intermittent rim discharge. The centrifuge has first and second members mounted in fixed positions relative to each other for rotation about a common axis. Each member has a peripheral edge portion extending about the common rotational axis with the portions being spaced from each other to create an annular gap therebetween. A third or rim member is mounted for rotation with the first and second members about the common rotational axis. The rim member has a cylindrical surface extending between the peripheral edge portions of the first and second members and is dimensioned to close the gap therebetween. The rim member is supported with its cylindrical surface substantially parallel to the rotational axis of the centrifuge; and, an opening-closing mechanism is provided that maintains the cylindrical surface substantially parallel to the rotational axis as it is moved to open and close the gap. The cylindrical surface is the only portion of the rim member exposed to the high, multi-directional fluid pressures of material being centrifuged. In this manner, the opening-closing mechanism for the rim member does not have to work against any force components generated by the centrifuged material other than radially directed ones which are uniformly directed against the cylindrical surface and offer relatively inconsequential resistance to the movement of the rim member. The rim opening means does not rotate with the centrifuge thereby simplifying the power transfer to it and adding no weight and imbalance problems to the rotating centrifuge.

31 Claims, 7 Drawing Figures

SOLID BOWL CENTRIFUGE WITH INTERMITTENT RIM DISCHARGE

FIELD OF THE INVENTION

This invention relates to the field of centrifuges and more particularly to the field of continuous feed, solid bowl centrifuges with intermittent rim discharge.

BACKGROUND OF THE INVENTION

Centrifuges are widely used throughout the world to separate materials having different properties. Chief among the types of centrifuges are ones with imperforate baskets and ones with perforate baskets. Centrifuges with imperforate baskets are commonly referred to as solid bowl centrifuges and are typically used to separate materials of different densities. In operation, the high speed of the rotating centrifuge centrifugally flings the denser materials to the outer regions of the bowl which displaces the less dense materials inwardly toward the rotational axis of the centrifuge. Contrastly, perforate basket centrifuges are typically used to separate materials based on differences in particle size rather than density; and, in such centrifuges, the centrifugal forces generated by the rotating centrifuge serve to throw all of the material outwardly against a perforate screen of a given mesh size. The particles smaller than the mesh size then pass outwardly through the screen while the particles larger than the mesh size collect on the screen for subsequent removal.

In the recycling of materials such as paper pulp, special problems are presented which can be uniquely solved using a combination of imperforate and perforate basket centrifuges. Specifically, all paper pulp recycling processes add water which necessarily requires that one or more of the steps in the process be a dewatering one. Such dewatering can be accomplished by using conventional drum filters, disc filters, or presses. However, due to the manner of their operation, these techniques tend to trap contaminating solids such as fillers and ink balls in the dewatered pulp. In contrast to these dewatering techniques, the use of a perforate basket centrifuge has been found to have several advantages in that it can not only remove more of the contaminating impurities but also can do so without using high contact pressures that can result in creating undesirable clumps in the pulp. A particularly successful perforate basket centrifuge for this purpose employs a perforate screen with a rotating screw conveyor positional interiorly of it. The conveyor flights of the screw rotate in the same direction as the perforate screen but at a different speed. In operation, the water and contaminants are flung outwardly through the perforate screen while the pulp fibers collect on it and are advanced toward the discharge end of the centrifuge by the rotating screw conveyor. In doing so, bundles of the fibers become trapped in the spaces between the conveyor flights and the perforate screen; and, as the conveyor rotates, the advancing fiber bundles become a wiping media which removes other fibers trapped across and within the holes of the perforate screen. The rotating conveyor also causes the fiber bundles to roll as they are advanced toward the discharge end of the centrifuge thereby enhancing the separation of the water and contaminants.

Although perforate basket centrifuges have been found to have excellent performance characteristics in the dewatering and contaminant separation of recycled materials such as paper pulp, they can be damaged by hard objects such as metal and glass. Consequently, it is highly desirable that such objects (which can include baling wire, metal strapping, paper clips, staples, glass, and sand) be removed from the pulp before it enters the perforate basket centrifuge otherwise damage can be done to the perforate screen. Techniques using pulper extractor plates, traps, magnets, and cyclone cleaners are only partially successful. In theory, a continuous feed, solid bowl centrifuge with an intermittent or batch discharge through its rim (other than nozzle or fixed orifice discharge means which are not capable of passing large objects such as baling wire, metal strapping and paper clips) is ideally suited to remove such objects. However, all presently known designs are both impractical and inefficient. For example, one known design mounts a rather heavy and complicated rim opening mechanism for rotation with the centrifuge. Understandably, this not only creates dynamic imbalance problems but also presents the inherent problem of transferring power to the rapidly rotating opening mechanism. Another problem with this design and all other known designs is that the rim is intermittently opened by moving portions of the solid bowl apart in a direction parallel to the rotational axis. Since these portions invariably have surfaces perpendicular or inclined to the rotational axis, the reclosing of the rim must then be done against the pressure of the centrifuged material which, in most cases, is quite substantial. Further, the angled surfaces create problems in keeping the bowl closed as the pressures generated within the centrifuge continuously tend to open the bowl. Consequently, the mechanism for closing the bowl and keeping it closed must likewise be quite substantial and capable of generating rather large forces. The end result in these known designs is an impractical and inefficient solid bowl centrifuge which cannot effectively be used with a downstream, perforate basket centrifuge.

It was with these problems in mind that the continuous feed, solid bowl centrifuge of the present invention was developed and particularly adapted for use alone and in combination with a continuous feed, perforate basket centrifuge. With the solid bowl centrifuge of the present invention and in its preferred environment, junk or tramp metal (e.g., baling wire, staples, paper clips) as well as glass and sand can be effectively and efficiently removed from recycled material such as paper pulp prior to its entry into a perforate basket centrifuge for further processing.

SUMMARY OF THE INVENTION

This invention involves a continuous feed, solid bowl centrifuge with intermittent rim discharge. The centrifuge has first and second members mounted in fixed positions relative to each other for rotation about a common axis. Each of the members has a peripheral edge portion extending about the common rotational axis and the peripheral edge portions are spaced from each other to create an annular gap therebetween. A third or rim member is mounted for rotation with the first and second members about the common rotational axis. The rim member has a cylindrical surface extending between the peripheral edge portions of the first and second members and the cylindrical surface is dimensioned to close the annular gap therebetween. The rim member is supported with its cylindrical surface substantially parallel to the rotational axis of the centrifuge; and, an opening-closing mechanism is provided that maintains the cylindrical surface substantially parallel to the rotational axis as it is moved to open and close the gap. Except for the cylindrical surface, the rim member has no other surface exposed to the high, multi-directional fluid pressures of the material being centrifuged. Because of this and by maintaining the cylindrical surface parallel to the rotational axis as it moves to open and close the gap, the rim member is exposed only to force components directly radially outwardly of the rotational axis. Consequently, in opening or closing the gap, the moving mechanism for the rim member does not have to work against any force components generated by the centrifuged material other than radially directed ones; and, these radially directed ones are uniformly directed against the cylindrical surface about the rotational axis and offer relatively inconsequential resistance to the movement of the rim member.

BRIEF DESCRIPTION OF THE DRAWINGS

FIG. 5 also illustrates the manner in which the rim member assumes a nutational-type movement about the rotational axis of the centrifuge when the rim member is in its open position.

DETAILED DESCRIPTION OF THE PREFERRED EMBODIMENTS

Figure 1:
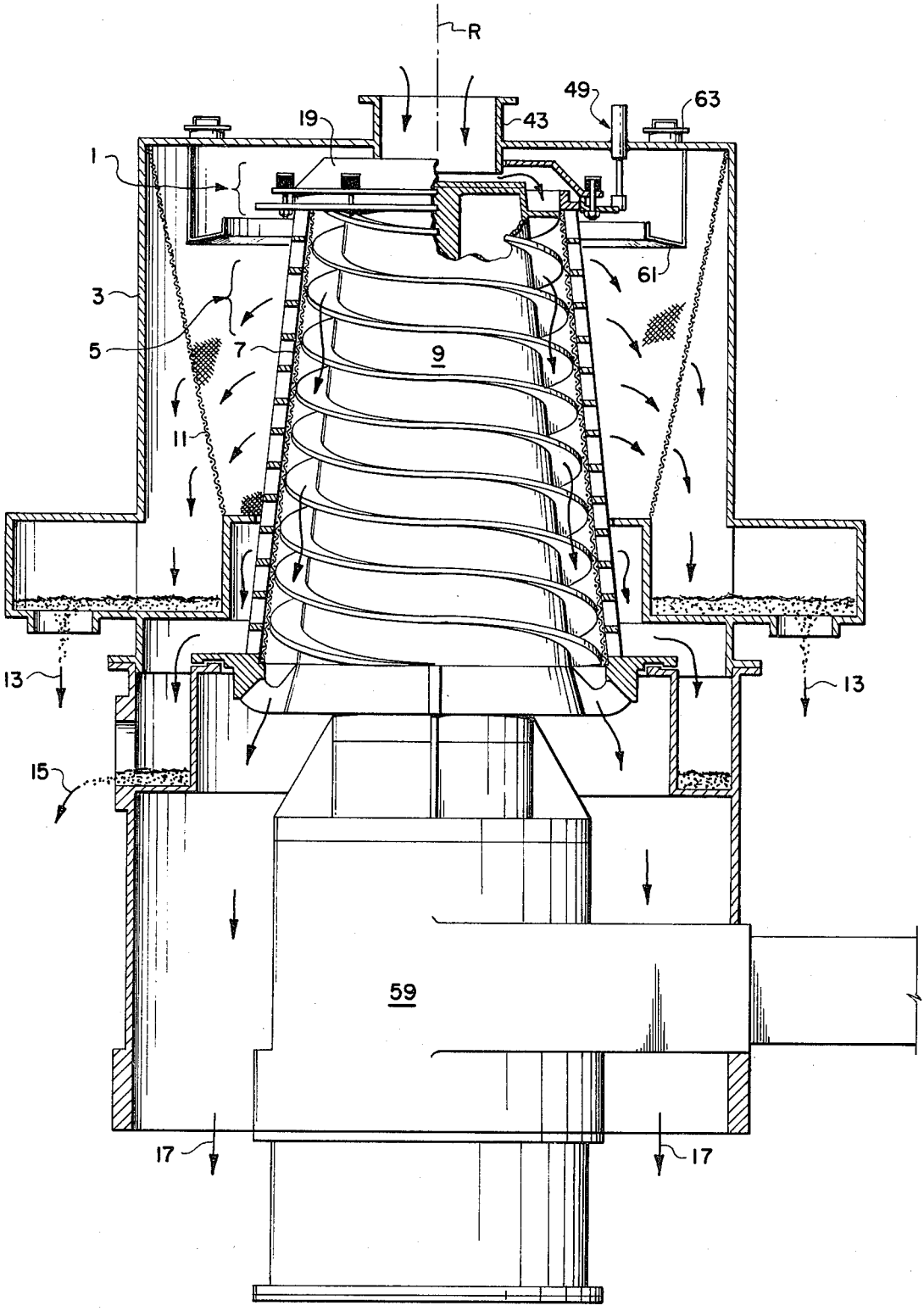
FIG. 1 illustrates the solid bowl centrifuge of the present invention in use with a downstream, perforate basket centrifuge.

Referring to FIG. 1, the solid bowl centrifuge 1 of the present invention is shown within the effluent housing 3 in use with a downstream, perforate basket centrifuge 5. In this combination and when, for example, a material such as paper pulp is being recycled, the solid bowl centrifuge 1 has been found to be ideally suited to separate and discharge junk or tramp metal (e.g., baling wire, metal strapping, paper clips, staples) as well as glass and sand from the pulp before it can enter and possible damage the perforate screen basket 7 of the downstream centrifuge 5. Further, as will be explained in more detail below, the material outlet of the solid bowl centrifuge 1 and the material inlet of the downstream centrifuge 5 are aligned so that the pulp is already up to speed with the rotating centrifuge 5 as it leaves the solid bowl 1 resulting in increased efficiency in the overall pulp dewatering-contaminent removal process.

The downstream, perforate basket centrifuge 5 illustrated in FIG. 1 includes the rotating, perforate screen basket 7 and rotating screw conveyor 9 positioned interiorly thereof. Outwardly of the basket 7 is scalping screen 11 and in use, filtered centrate is discharged at 13, high fiber centrate at 15, and dewatered pulp at 17. The perforate basket 7 and screw conveyor 9 rotate in the same direction about the common rotational axis R but do so at different speeds. In operation, the water and contaminants are flung outwardly through the perforate basket 7 while the pulp fibers collect on it and are advanced toward the pulp discharge 17 of the centrifuge 5 by the rotating screw conveyor 9. In doing so, bundles of the fibers become trapped in the spaces between the conveyor flights and the perforate basket 7; and, as the conveyor 9 rotates, the advancing fiber bundles become a wiping media which removes other fibers trapped across and within the holes of the perforate basket 7. The rotating conveyor 9 also causes the fiber bundles to roll as they are advanced toward the pulp discharge 17 of the centrifuge 5 thereby enhancing the separation of the water and contaminating impurities.

Figure 2:
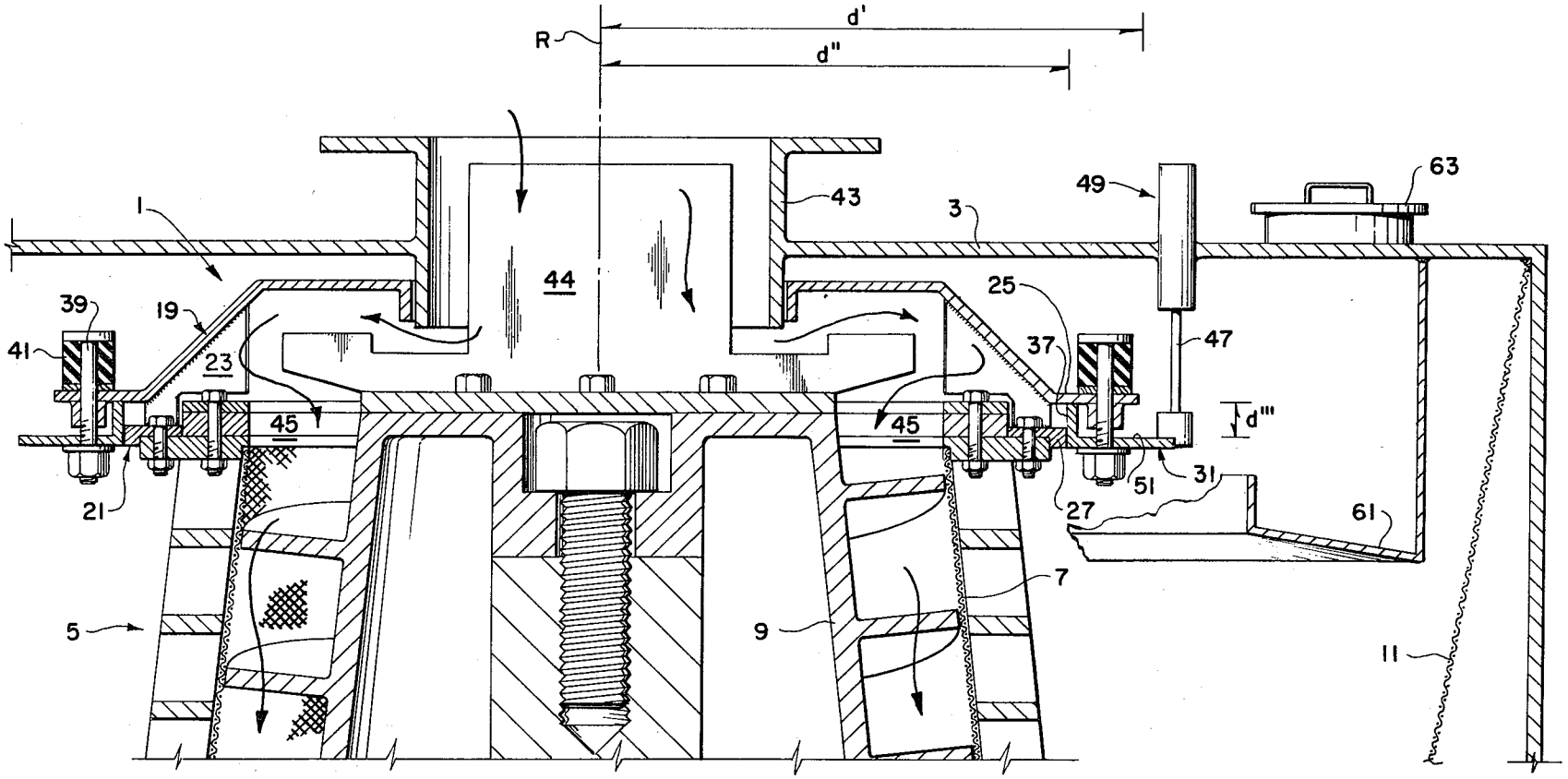
FIG. 2 is a cross-sectional view of the solid bowl centrifuge of the present invention and the inlet portion of the downstream, perforate basket centrifuge.
Figure 3:
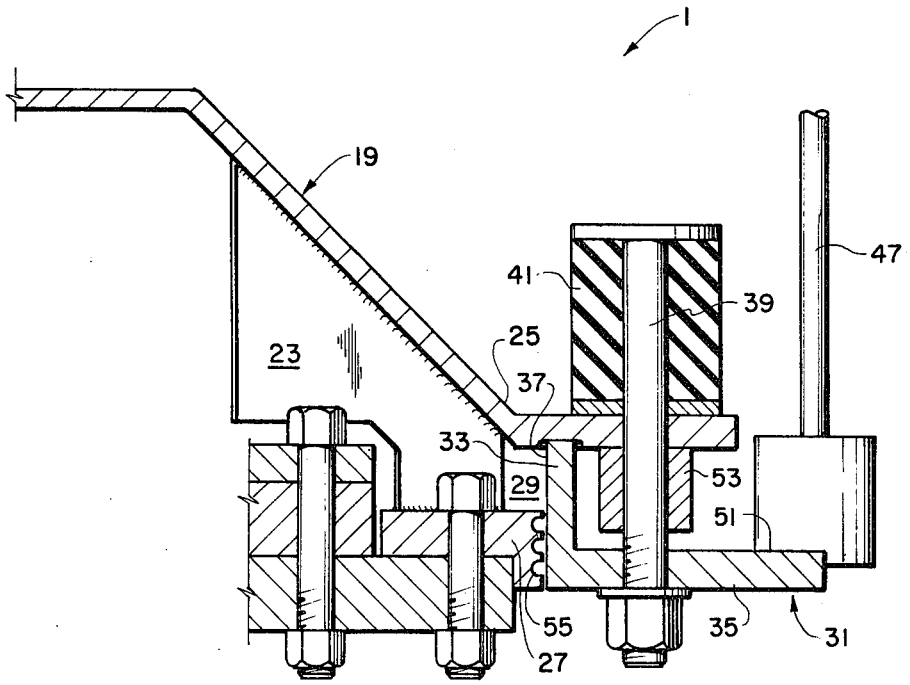
FIG. 3 is a cross-sectional view showing the rim member of the solid bowl centrifuge in its closed position extending between the peripheral edge portions of the upper and lower bowl members of the centrifuge.
Figure 4:
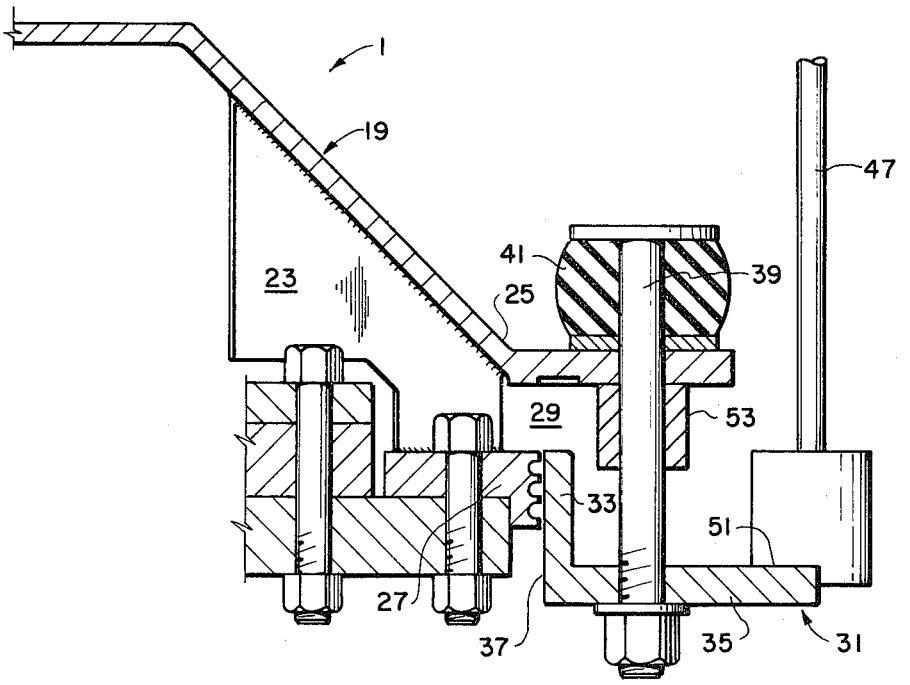
FIG. 4 is a cross-sectional view similar to FIG. 3 showing the rim member of the solid bowl centrifuge in its open position.
Figure 6:
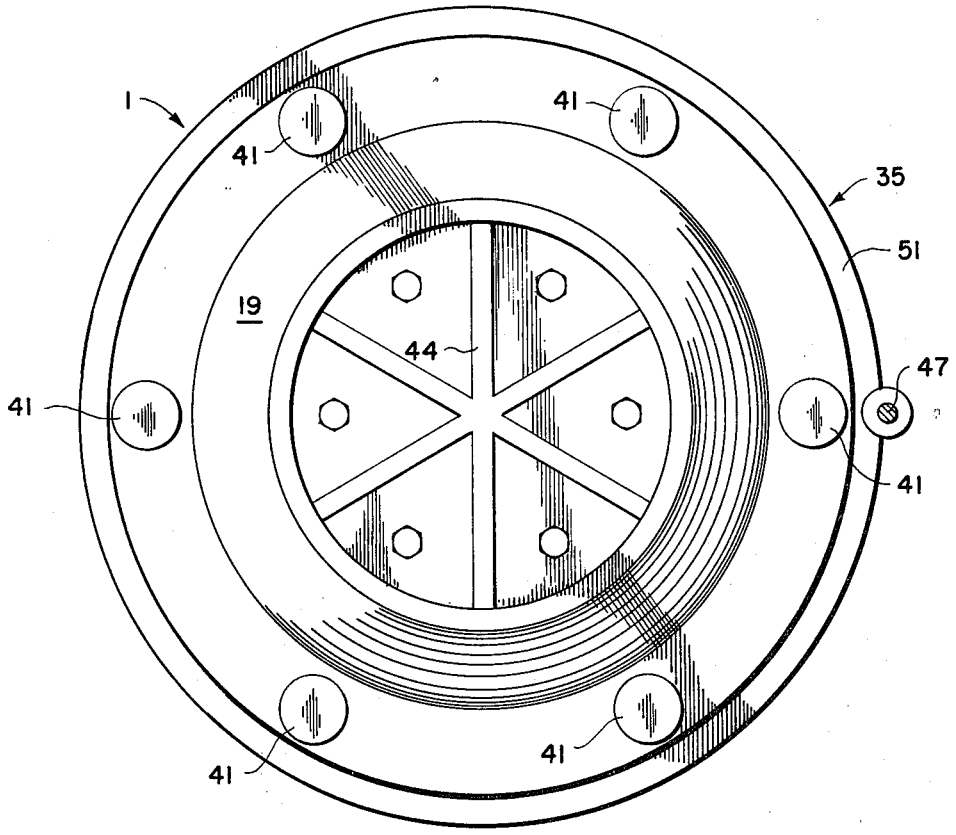
FIG. 6 is a top view taken along line 6—6 of FIG. 5 illustrating the placement of the rim biasing means about the rotational axis of the centrifuge and further illustrating the preferred design in which the opening means for the rim member is located at a fixed location and does not rotate with the centrifuge.
Figure 7:
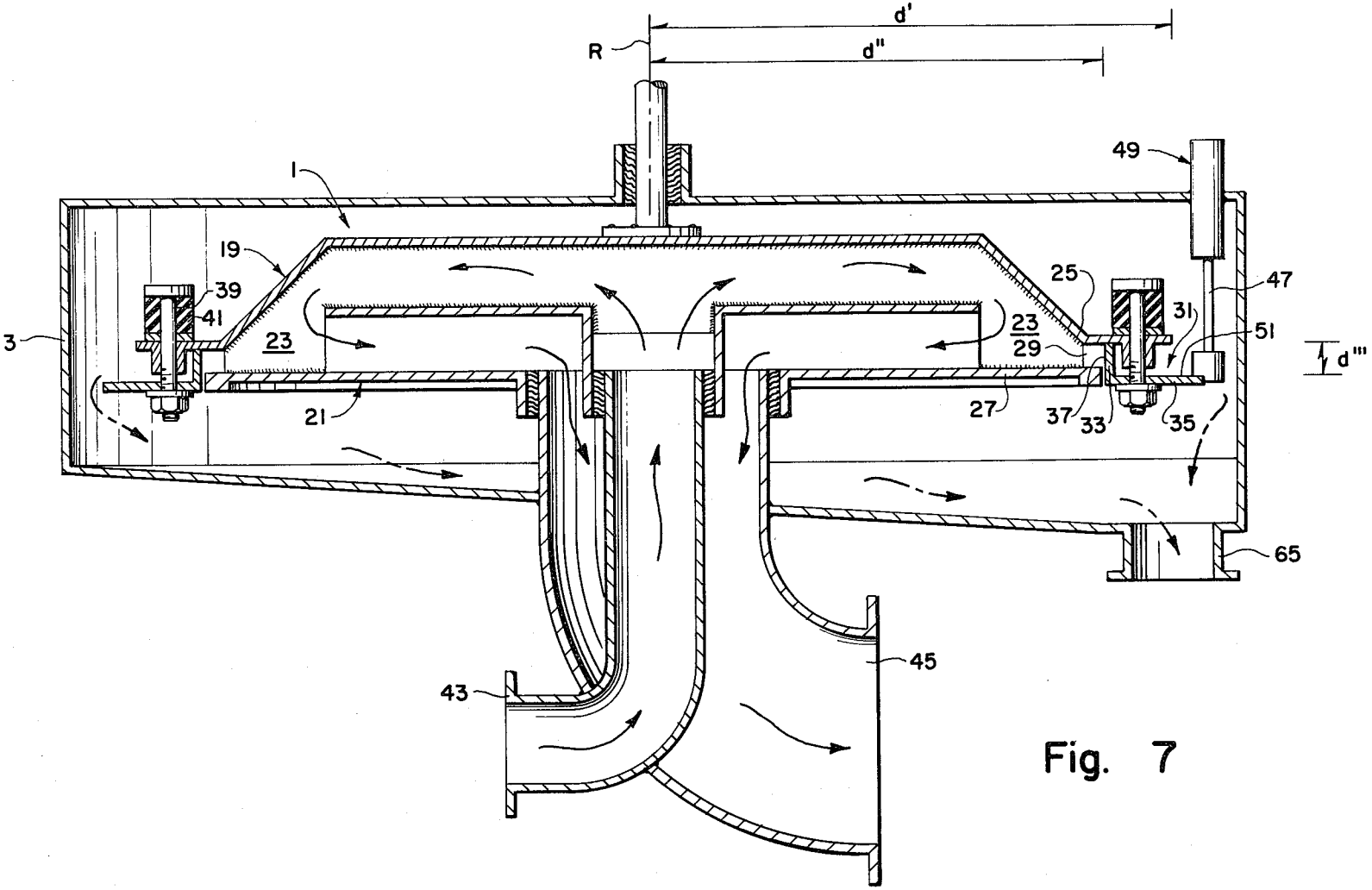
FIG. 7 illustrates the solid bowl centrifuge of the present invention in use as a separate unit outside of the combination of FIGS. 1–6.

As seen in FIGS. 2–4, and as perhaps best seen in FIG. 7, the solid bowl centrifuge 1 of the present invention includes upper and lower bowl members 19 and 21 which are mounted in fixed relation to each other by structure including baffles 23 for rotation in unison about the common vertical axis R. Each bowl member 19 and 21 has an outer peripheral edge portion 25 and 27 extending about the common rotational axis R. The peripheral edge portions 25 and 27 also extend outwardly of the common rotational axis R for first and second distances (d′ and d″) and are spaced from each other a third distance (d‴) in a direction parallel to the axis R whereby an annular gap is formed therebetween at 29 (see FIG. 4). The rim member 31 is generally annular in shape and has two right angle portions 33 and 35 (FIGS. 3 and 4). The inner surface 37 of portion 33 is substantially cylindrical about a radius substantially the same as the distance d″ (i.e., the distance the lower bowl member 21 extends outwardly of the common rotational axis R) and has a height at least as great as the gap 29 (d‴). As shown in FIGS. 3–7, the rim member 31 is mounted to the upper bowl member 19 by means of a plurality of bolts 39 which are spaced at intervals about the common rotational axis R (see FIGS. 5 and 6). The bolts 39 are biased by springs 41 toward the position shown in FIG. 3 in which the cylindrical surface 37 of the rim member 31 is substantially parallel to the common rotational axis R and extends substantially between the upper and lower bowl members 19 and 21 to close the gap 29 therebetween.

Figure 5:
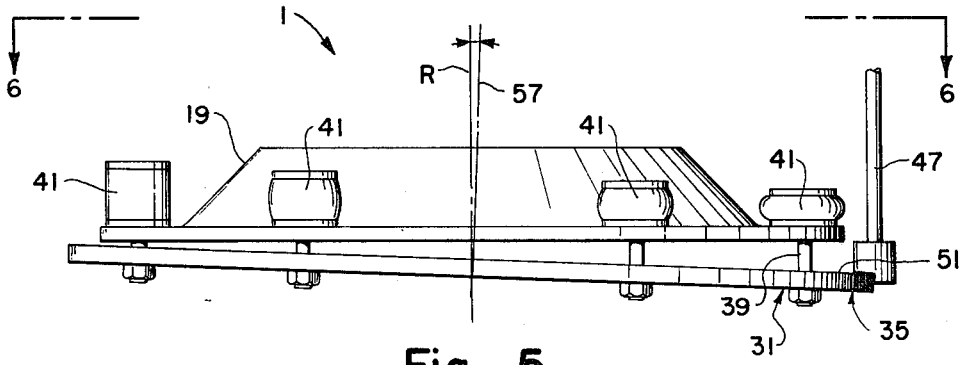
FIG. 5 is a simplified view of the preferred manner of opening the rim of the solid bowl centrifuge for intermittent discharge therethrough. In this simplified view, the upstanding portion of the rim member which extends substantially parallel to the rotational axis of the centrifuge and serves to close the bowl is not shown in order to more clearly illustrate the opening-closing mechanism of the centrifuge.

In the normal operation of the embodiment of FIGS. 1–6, the upper and lower bowl members 19 and 21 and rim member 31 of the solid bowl centrifuge 1 rotate in unison about the common rotational axis R with the rim member 31 biased in its closed position of FIGS. 1–3. As best seen in FIG. 2, material (e.g., pulp) is continuously fed through the inlet 43 of the effluent housing 3 past rotating baffles 44 into the solid bowl centrifuge 1 where it is flung outwardly. The centrifuged material exits the solid bowl centrifuge 1 at 45 to enter the perforate basket centrifuge 5 between the rotating conveyor 9 and perforate screen basket 7. In this manner, the material exiting the solid bowl centrifuge 1 is already up to speed with the rotating, perforate basket centrifuge 5. In normal operation and under the influence of the centrifugal forces generated by the centrifuge 1, the denser junk metal, sand, and glass in the pulp collect outwardly of the exit 45 of the centrifuge 1 in the space bounded by the peripheral edge portions 25 and 27 of the members 19 and 21 and surface 37 of the rim member 31 (FIG. 3). At periodic intervals or as desired, the plunger 47 of the piston-cylinder arrangement 49 (which is stationary at a fixed location about the common rotational axis R as shown in FIGS. 5 and 6 and does not rotate with the centrifuge 1) is moved at a substantially right angle to the annular surface 51 of the rim member 31. The plunger 47 applies a pressure substantially opposite to and greater than the substantially uniform pressure applied by the biasing springs 41 on the rim member 31 herein the rim member 31 is moved to its open position of FIG. 4.

As shown in FIGS. 3 and 4, the bolts 39 are slidingly received in the guides 53 (which are fixed to the upper bowl member 19) wherein the cylindrical surface 37 of the rim member 31 is maintained in substantially parallel alignment with the common rotational axis R as it is moved between its open and closed positions. If desired, the top of the upstanding portion 33 can be beveled on one or both sides. As best seen in FIGS. 3 and 4, the cylindrical surface 37 is the only part of the rim member 31 that is exposed to the high, multi-directional fluid pressures of the material being centrifuged. In essence, the peripheral edge portions 25 and 27 and the cylindrical surface 37 in its closed position of FIG. 3 present an imperforate barrier which shields the remainder of the rim member 31 from the material pressures developed in the rotating centrifuge 1. The semi-circular indentions 55 in the outer edge of the peripheral edge portion 21 form a renewable seal of partially dewatered pulp in a known manner. If desired, the semi-circular indentions 55 on the member 21 can be replaced by other conventional sealing structures such as elastomer O-rings, lip seals, or gaskets. Because of the shielding effect of members 25, 27, and 37 and because the opening-closing mechanism or moving means of members 39, 41, 47, and 53 maintain the cylindrical surface 37 substantially parallel to the common rotational axis R as it is moved to close and open the gap 29, the opening-closing mechanism for the rim member 31 can rather easily move it. This is due in large part because the opening-closing mechanism does not have to work against any force components generated by the centrifuged material other than radially directed ones; and, these radially directed ones are uniformly directed against the cylindrical surface 37 about the common rotational axis R and offer relatively inconsequential resistance to the movement of the rim member 31.

Although multiple piston-cylinder arrangements such as 49 can be used to open the rim member 31, the preferred embodiment as illustrated in FIGS. 5 and 6 uses only one. In the simplified and exaggerated view of FIG. 5, the upstanding portion 33 of the rim member is not shown in order to more clearly illustrate the preferred position assumed by the rim member 31 when it is in its open position of FIG. 4. In the exaggerated view of FIG. 5, it is shown that in the preferred manner of operation using a single piston-cylinder arrangement with a single plunger 47, the axis of rotation 57 of the rim member 31 actually moves away from the common rotational axis R by a few degrees (on the order of one or two) wherein the rim member 31 assumes a nutational-type movement about the axis R. Because this offset is only on the order of a few degrees, the cylindrical surface 37 of the rim member 31 for all practical purposes still remains substantially parallel to the axis R as it moves between its closed and open positions of FIGS. 3 and 4.

In the preferred combination of FIG. 1, the solid bowl centrifuge 1 is used within the effluent housing 3 with the downstream, perforate basket centrifuge 5. In this combination, the centrifuges 1 and 5 are both driven by motor and transmission means 59 to rotate at the same angular velocity about the common rotational axis R. Forces on the order of 50-400 G's are exerted on the material within centrifuge 1 and with its placement on the centrifuge 5 about the common rotational axis R, very little additional if any additional horsepower from motor and transmission means 59 is required to power the combination of centrifuges 1 and 5. In this combination, an annular tray 61 (see FIGS. 1 and 2) can be provided to catch and hold the junk metal, glass, and sand being periodically discharged from the solid bowl centrifuge 1. Hatches 63 can be opened as desired to remove the collected materials. As discussed above, the combination of the solid bowl centrifuge 1 and perforate basket centrifuge 5 has been found to be of particular benefit in recycling materials such as paper pulp. Specifically, the solid bowl centrifuge 1 not only removes junk metal, glass, and sand which can damage the perforate basket 7 of the downstream centrifuge 5 but also serves to bring the material being continuously fed into the solid bowl centrifuge 1 up to speed with the rotating centrifuge 5 for increased efficiency in the overall pulp dewatering-contaminent removal process.

In the normal operation of the embodiment of FIG. 7, upper and lower bowl members 19 and 21 and rim member 31 of the solid bowl centrifuge 1 rotate in unison about the common rotational axis R with the rim member 31 biased in its closed position. Material is continuously fed through inlet 43 into the solid bowl centrifuge 1 where it is flung outwardly and normally exits at 45. In operation and under the influence of the centrifuge forces generated by the centrifuge 1, the denser junk metal, sand, and glass in the pulp collect in the space bounded by the peripheral edge portions 25 and 27 of members 19 and 21 and surface 37 of the rim member 31. At periodis intervals or as desired and in the manner of the embodiment of FIGS. 1-6, the plunger 47 of the piston-cylinder arrangements 49 is moved at a substantially right angle to the annular surface 51 of the rim member 31. The plunger 47 applies a pressure substantially opposite to and greater than the substantially uniform pressure applied by the biasing springs 41 on the rim member 31. In this manner, the rim member 31 is moved to its open position to discharge the accumulated junk metal, sand, and glass outwardly of the centrifuge 1 into the effluent housing 3 where it exits at 65.

While several embodiments of the present invention have been described in detail herein, it is understood that various changes and modifications can be made without departing from the scope of the invention.

We claim:

1. A centrifuge comprising:

first and second members and means for mounting said first and second members for rotation about a common axis, each of said first and second members having a peripheral edge portion extending about said common rotational axis and extending outwardly of said common rotational axis for respective first and second distances, said mounting means mounting said first and second members with said peripheral edge portions thereof spaced from each other a third distance in a direction substantially parallel to said common rotational axis whereby a gap is formed between said peripheral edge portions, a third member having at least a first substantially cylindrical surface of a radius substantially the same as the smaller of said first and second distances and extending in a direction substantially perpendicular to said radius for a height at least as great as said third distance, means for mounting said third member about said common rotational axis with said first substantially cylindrical surface substantially parallel to said common rotational axis and extending between the peripheral edge portions of said first and second members to substantially close the gap therebetween, means for rotating said first, second, and third means at a substantially common angular velocity about said common rotational axis, and, means for selectively moving said first cylindrical surface of said third member relative to said first and second members between a closed position extending between the peripheral edge portions of said first and second members and closing said gap and an open position opening said gap for the discharge of material therethrough.

2. The centrifuge of claim 1 further including means for maintaining said first cylindrical surfaces in substantially parallel alignment with said common rotational axis as said first cylindrical surface is moved between said open and closed positions.

3. The centrifuge of claim 1 wherein said mounting means for said first and second members includes means for mounting said first and second members in fixed positions relative to each other.

4. The centrifuge of claim 1 wherein said moving means includes closing means for moving said cylindrical surface from said open position to said closed position and opening means for moving said cylindrical surface from said closed position to said open position, said centrifuge further including means for mounting at least one of said opening and closing means of said moving means at a fixed location about said common rotational axis whereby said at least one of said opening and closing means does not rotate about said common rotational axis.

5. The centrifuge of claim 1 wherein said means for mounting said third member includes means for biasing said third member toward said closed position with said first cylindrical surface thereof extending between the peripheral edge portions of said first and second members and closing the gap therebetween.

6. The centrifuge of claim 5 wherein said biasing means includes means for applying a substantially uniform, first pressure to said third member about said common rotational axis tending to hold said third member in said closed position and said moving means includes means for applying a second pressure to said third member, said second pressure being substantially opposite to and greater than said first pressure whereby said third member is moved away from said closed position to open said gap for material to be discharged therethrough.

7. The centrifuge of claim 1 wherein said third member rotates about said common rotational axis in said closed position and said means for selectively moving said first cylindrical surface of said third member includes means for causing said third member to rotate about an axis different from said common rotational axis when said gap is opened.

8. The cengtrifuge of claim 1 wherein said mounting means for said first and second members mounts said first and second members with said peripheral edge portions thereof substantially uniformly spaced from each other about said common rotational axis thereby forming a substantially annular gap therebetween.

9. The centrifuge of claim 1 wherein the first cylindrical surface of said third member and said peripheral edge portions of said first and second members inwardly of said cylindrical surface toward said common rotational axis are imperforate whereby an imperforate barrier is formed thereby when said first cylindrical surface is in the closed position extending between the peripheral edge portions of said first and second members to close the gap therebetween and whereby the remaining portion of said third member is positioned outwardly of said barrier relative to said common rotational axis and is shielded by said barrier from the pressures developed in the rotating centrifuge.

10. The centrifuge of claim 1 wherein said first cylindrical surface of said third member and each of said peripheral edge portions of said first and second members outwardly of said common rotational axis for a distance at least equal to the smaller of said first and second distances are imperforate whereby an imperforate barrier is formed thereby when said first cylindrical surface is in the closed position extending between the peripheral edge portions of said first and second members to close the gap therebetween and whereby the remaining portion of said third member is positioned outwardly of said barrier relative to said common rotational axis and is shielded by said barrier from the pressures developed in the centrifuge.

11. The centrifuge of claim 1 wherein said first member has at least one inlet therethrough and said second member has at least one outlet therethrough, said inlet being spaced inwardly of said peripheral edge portion of said first member toward said common rotational axis, and said centrifuge further including means for continuously feeding material into said inlet.

12. The centrifuge of claim 6 wherein said third member further includes a portion extending outwardly of said first cylindrical surface relative to said common rotational axis, said portion having a second surface extending about and substantially perpendicular to said common rotational axis, said means for applying said second pressure including at least one member and means for moving said one member against said second surface to apply said second pressure.

13. The centrifuge of claim 6 wherein said moving means includes closing means for moving said cylindrical surface from said open position to said closed position and opening means for moving said cylindrical surface from said closed position to said open position, said centrifuge further including means for mounting at least one of said opening and closing means of said opening and closing means of said moving means at a fixed location about said common rotational axis whereby said at least one of said opening and closing means does not rotate about said common rotational axis.

14. The centrifuge of claim 11 wherein said first cylindrical surface of said third member and each of said peripheral edge portions of said first and second members inwardly of said cylindrical surface toward said common rotational axis are imperforate, said outlet of said second member being spaced farther from said common rotational axis than the inlet of said first member, and said centrifuge is used upstream of and in combination with a second centrifuge, said second centrifuge having an inlet and outlet and being mounted for rotation about said common rotational axis, said inlet of said second centrifuge and the outlet of said second member being spaced from said common rotational axis a substantially common distance and being in fluid communication with each other whereby material exiting through the outlet of said second member into the inlet of said second centrifuge is already up to speed with the rotating second centrifuge.

15. The centrifuge of claim 14 wherein said first cylindrical surface of said third member and each of said peripheral edge portions of said first and second members inwardly of said cylindrical surface toward said common rotational axis are imperforate and said centrifuge is used in combination with a second centrifuge, said second centrifuge having an inlet in fluid communication with the outlet of the first centrifuge to receive material therefrom, said second centrifuge further having an outlet and including a screw conveyor, means for mounting said screw conveyor for rotation about said common rotational axis, a substantially cylindrically shaped, perforate member of radial dimension greater than said screw conveyor, means for mounting said perforate member about said screw conveyor for rotation about said common rotational axis, and means for rotating said screw conveyor and said perforate member about said common rotational axis.

16. The centrifuge of claim 8 wherein said third member rotates about said common rotational axis in said closed position and said means for applying second pressure applies said second pressure at said fixed location about said common rotational axis in a direction generally parallel thereto whereby said third member is moved away from said closed position and the rotational axis of said third member is moved away from said common rotational axis.

17. A method for selectively discharging material outwardly of a centrifuge, said method comprising the steps of:

(a) mounting first and second members for rotation about a common axis with peripheral edge portions thereof spaced from each other in a direction substantially parallel to said common rotational axis whereby a gap is formed between said peripheral edge portions, (b) mounting a third member with a first substantially cylindrical surface about said common rotational axis with said cylindrical surface substantially parallel to said common rotational axis and extending between the peripheral edge portions of said first and second members to substantially close the gap therebetween, (c) rotating said first, second, and third members at a substantially common angular velocity about said common rotational axis, and, (d) selectively moving said first cylindrical surface of said third member relative to said first and second members between a closed position extending between the peripheral edge portions of said first and second members and closing said gap and an open position opening said gap for the discharge of material therethrough.

18. The method of claim 17 further including the step of:

(e) maintaining said first cylindrical surface in substantially parallel alignment with said common rotational axis as said first cylindrical surface is moved between said open and closed positions.

19. The method of claim 17 wherein step (a) further includes the limitation of mounting said first and second members in fixed positions relative to each other.

20. The method of claim 17 wherein step (d) further includes the limitation of selectively moving said first cylindrical surface of said third member by applying a force to said third member in a direction substantially parallel to said common rotational axis.

21. The method of claim 17 wherein step (d) further includes the limitation of selectively moving said first cylindrical surface of said third member by applying a force to said rotating third member at a fixed location about said common rotational axis.

22. The method of claim 17 further including the step of applying a substantially uniform, first pressure to said third member about said common rotational axis to bias said third member toward a position closing the gap between the peripheral edge portions of said first and second members.

23. The method of claim 17 wherein step (a) includes the further limitation of forming a substantially annular gap between said peripheral edge portion of said first and second members.

24. The method of claim 17 wherein step (d) further includes the limitation of causing said third member to rotate about an axis different from said common rotational axis when said gap is opened.

25. The method of claim 17 further including the step of continuously feeding material into an inlet in said first member and out of an outlet in said second member.

26. The method of claim 22 wherein step (d) further includes the limitation of selectively moving said first cylindrical surface of said third member by applying a second pressure to said third member, said second pressure being substantially opposite to and greater than said first pressure whereby said third member is moved away from said closed position to open said gap for material to be discharged therethrough.

27. The method of claim 25 further including the steps of making the first cylindrical surface of said third member and said peripheral edge portions of said first and second members inwardly of said cylindrical surface toward said common rotational axis imperforate whereby an imperforate barrier is presented thereby to said material when said first cylindrical surface is in the closed position of step (b), and mounting the remainder of said third member outwardly of said barrier relative to said common rotational axis whereby said barrier shields the remainder of said third member from the pressures developed in the rotating centrifuge.

28. The method of claim 25 further including the steps of making the first cylindrical surface of said third member and said peripheral edge portions of said first and second members inwardly of said cylindrical surface toward said common rotational axis imperforate, spacing said outlet further from said common rotational axis than said inlet, mounting a second centrifuge with an inlet and outlet for rotation about said common rotational axis, spacing the inlet of said second centrifuge and the outlet of said second member a substantially common distance from said common rotational axis, placing said inlet of said second centrifuge and said outlet of said second member in fluid communication with each other, and advancing said material through said outlet of said second member into the inlet of said second centrifuge whereby said material is already up to speed with said rotating second centrifuge.

29. The method of claim 28 further including the steps of making the first cylindrical surface of said third member and said peripheral edge portions of said first and second members imperforate, mounting a screw conveyor for rotation about said common rotational axis, mounting a perforate member spaced from and about said screw conveyor for rotation about said common rotational axis, rotating said screw conveyor and perforate member about said common rotational axis, placing the space between said screw conveyor and said perforate member in fluid communication with the outlet of said second member, and advancing said material through said outlet of said second member and into said space between said screw conveyor and said perforate member.

30. The method of claim 23 further including the limitation of applying said second pressure to said rotating third member at a fixed location about said common rotational axis.

31. The method of claim 24 further including the limitation of applying said second pressure in a direction generally parallel to said common rotational axis whereby said third member is moved away from said closed position and the rotational axis of said third member is moved away from said common rotational axis.

* * * * *